US005362246A

United States Patent [19]

Lau

[11] Patent Number: 5,362,246

[45] Date of Patent: Nov. 8, 1994

[54] CONVERTIBLE FLUORESCENT ADAPTOR WITH COMPACTED INSTALLATION MODE

[76] Inventor: Kenneth Lau, 2588-D El Camino Real #383, Carlsbad, Calif. 92008

[21] Appl. No.: 61,599

[22] Filed: May 12, 1993

[51] Int. Cl.[5] ..... H01R 33/02

[52] U.S. Cl. ..... 439/231; 439/236

[58] Field of Search ..... 439/638–640, 439/236–243; 313/317, 318; 315/57, 58, 71, 70

[56] References Cited

U.S. PATENT DOCUMENTS 4,645,283 2/1987 MacDonald et al. ..... 439/236
4,683,402 7/1987 Aubrey ..... 439/236
4,723,200 2/1988 Troen ..... 439/236
4,936,789 6/1990 Ugalde ..... 439/236

*Primary Examiner*—David L. Pirlot
*Attorney, Agent, or Firm*—Ralph S. Branscomb

[57] ABSTRACT

A fluorescent adaptor designed to engage incandescent light bulb sockets such as the typical threaded socket, has movable parts which house all or part of the ballast. The parts are slidably or pivotally connected, and move into a low-profile configuration permitting the unit to be rotated into place in a confined space meant for a light bulb Subsequent to installation, the parts are expanded again to permit insertion of a fluorescent tube in its optimal position and orientation in the fixture.

15 Claims, 3 Drawing Sheets

CONVERTIBLE FLUORESCENT ADAPTOR WITH COMPACTED INSTALLATION MODE

BACKGROUND OF THE INVENTION

The invention is in the field of fluorescent tube mounting sockets or bases, and particularly addresses base adapters which enable a fluorescent tube to be mounted in a fixture designed for incandescents, such as the ubiquitous threaded light bulb socket. A companion application for an invention entitled, FLUORESCENT LIGHT BALLAST LAMP MOUNTING ASSEMBLY CONSTRUCTION filed on Feb. 10, 1992 with Ser. No. 832,988 represents the developmental predecessor of the invention set forth in this disclosure. The device of that disclosure minimizes the profile of the ballast housing in several ways to permit the base to be mounted in more confined spaces than is presently possible.

It is well known that compact fluorescent lamps designed to replace incandescents can save up to 75% on energy consumption compared to incandescent lamps of the same lumen output, and have lifespans eight- to ten-times greater. Such fluorescent lamps, in various size, shape and wattage configurations are commercially available from lamp manufacturers such as Phillips Lighting, General Electric, Osram Sylvania, and Panasonic.

Most of these adaptors are re-usable, being equipped with built-in ballasts and screw bases permitting replacement of the lamps alone, for easy and minimally expensive conversion of incandescent lamp fixtures to fluorescent. However, since most installations where such adaptors would be implemented were designed for use with a relatively compact light bulb, existing adaptors cannot handle the spacial constraints of many conversion situations. The following patents are representative of current adaptors:

| | | | | |
|---|---|---|---|---|
| 1. | 4,414,489 | 11/1983 | Young | 315/51 |
| 2. | 4,570,105 | 2/1986 | Engel | 315/58 |
| 3. | 4,623,823 | 11/1986 | Engel | 315/58 |
| 4. | 4,683,402 | 7/1987 | Aubrey | 313/318 |
| 5. | 4,746,840 | 5/1988 | Lam | 315/56/58 |
| 6. | 4,939,420 | 7/1990 | Lam | 315/56/58 |

For example, the devices disclosed in U.S. Pat. Nos. 4,683,402 and 4,495,443 cannot fit into recessed fixtures with reflectors designed for horizontally mounted pear-shaped incandescent light bulbs as the side-mounted ballasts need more clearance in order to be rotated into place on installation.

The adaptors of U.S. Pat. Nos. 4,570,105 and 4,683,402, cannot fit into lamp shade harps due to bulky cylindrical ballast housing.

U.S. Pat. Nos. 4,939,420 and 4,746,840 illustrate adapters which are made solely for use as fluorescent reflector lamps lack versatility. Neither of these lamps will fit in existing lamps having shade-mounting harps.

There are considerations other than, but related to, spacial constraints. For example, the base of the compact fluorescent lamp is the hottest spot on the lamp and should not be enclosed any more than is absolutely necessary. Certainly it shouldn't be embedded into and encompassed by the housing of the ballast, as it would be unsafe and would reduce the lamp's service life. However., U.S. Pat. Nos. 4,570,105 and 4,623,823 use toroidal ballasts that enclose this hot spot. U.S. Pat. No. 4,683,402 has a recessed ballast housing which also imbeds the lamp base into the ballast. These units do not provide the airspace or ventilation needed for optimal lifespan.

The temperature of the lamp base can reach 150 C. degrees, and the highest temperatures are generally reached at the end of lamp life. In this condition, the lamp no longer starts and maximum energy is dissipated on the lamp base without producing light. These and other adaptors that imbed the fluorescent lamp base in the ballast are failure-prone designs which create temperatures considerably in excess of the recommendations of lamp manufacturers, causing early deterioration and failure of lamp starters and the ballast components. The destructive effect of heat is especially acute when the lamp is mounted in the base-up position, as on a ceiling, as the rising heat pools around the hot spot and accelerates the deterioration.

The purpose of having re-usable adaptors is obviously to require replacement of only the bare tube, when it burns out, and not a lot of perfectly good electronic components. But if the adaptor generates such high temperatures at the lamp base that the tube and the ballast suffer early failure, the economic aim of reusable adaptors is defeated.

There is a need for more user-friendly adaptors that can be easily installed without modifying existing light fixtures (which are generally unmodifiable anyway), are compatible with modern compact fluorescent lamps, fit into the limited spaces which were designed for the smaller sized incandescent lamps, and which do not destroy the fluorescent tube or ballast prematurely through overheating.

SUMMARY OF THE INVENTION

The instant invention moves beyond the disclosure of the first invention, referenced above. Although the fixture is designed to occupy a minimal volume, its real inventive advantage lies in its use of moving parts, which are shifted between different positions in the installation mode and operating mode to minimize the planform dimension of the fixture as it is rotated into place, subsequent to which the moving parts are repositioned for the optimum operational configuration.

The first discussed embodiment has an adaptor body with the threaded base being slidably mounted with respect to the rest of the body. The body cannot be slid relative to the threaded base until the body is substantially centered, so that as it rotates during installation the minimum planform in the plane transverse to the mounting socket axis is achieved, rather than having a much larger planform as would be achieved with a lop-sided body. Once in place, the adaptor body is slid relative to the base until the fluorescent tube mounting socket is in direct alignment with the incandescent socket into which the unit is threadably engaged. This results in the centering of the light in the lamp, and the lop-sided configuration of the non-illuminating parts of the fixture, which are not generally visible. Maximum longitudinal compaction is achieved by allowing the fluorescent tube base to slide partially inside the volume of the incandescent light socket.

Two additional embodiments utilize a pivotal connection between the adaptor components. One of these embodiments has a pair of cooperating ballast housing halves which pivot up over the tube socket entryway or threshold (the tube having been removed), to absolutely minimize the planform dimension in the plane perpendicular to the base axis during installation. Once installed, these two ballast housing lobes are pivoted back out again, exposing the socket for insertion of the fluorescent tube.

The other pivotal embodiment enables the tube to be mounted either perpendicularly or parallel to the bulb socket axis, or anywhere in between, for that matter. This accommodates incandescent bulb spaces which may be adapted more to an angular tube configuration than to the orthogonally extended standard, as well as confined orthogonal arrangements.

Several further options are disclosed, including an axially sliding base, used by itself or in conjunction with others of the features disclosed in the description, and a ratchet-type mounting base which permits the base to be rotated independently of the body of the adaptor during mounting.

DETAILED DESCRIPTION OF THE PREFERRED EMBODIMENT

Figure 1:
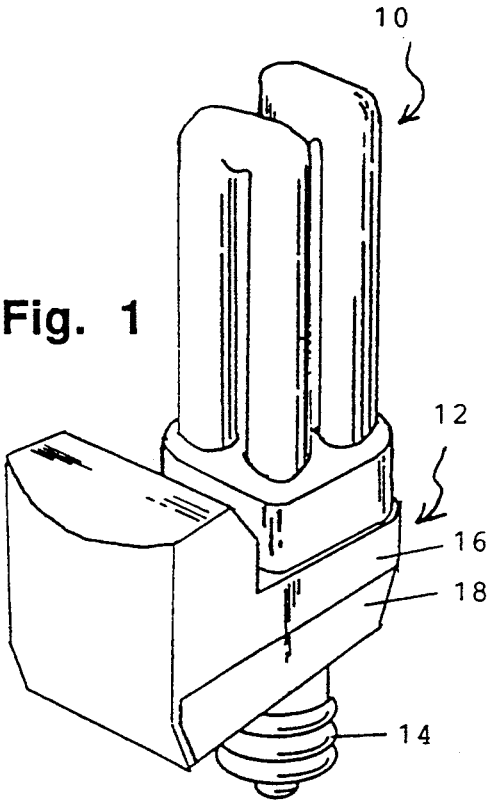
FIG. 1 is a perspective view of a first embodiment of the adaptor which uses a traditional iron core-and-windings style ballast, shown with a fluorescent tube mounted.

The fluorescent adaptor is shown at 10 in FIG. 1 in its first embodiment, in which it has a body 12 and a base 14 adapted to screw into an incandescent light socket (with this and the other embodiments a threaded base is shown for simplicity, but all types of connection, such as spade or bayonet connectors, are intended to be included in the scope of the disclosure and claims). The base and body slide back and forth relative to one another as can best be visualized from the exploded perspective of FIG. 2. This simple construction uses a plastic shell for the adaptor body, having an upper half shell 16 and a lower half shell 18. For the sake of brevity, every engineering detail is not shown in this or the subsequent embodiments of the invention, inasmuch as the broad functionality as set forth in the claims is independent from details of construction, these details being known to those knowledgeable in the arts involved.

Figure 2:
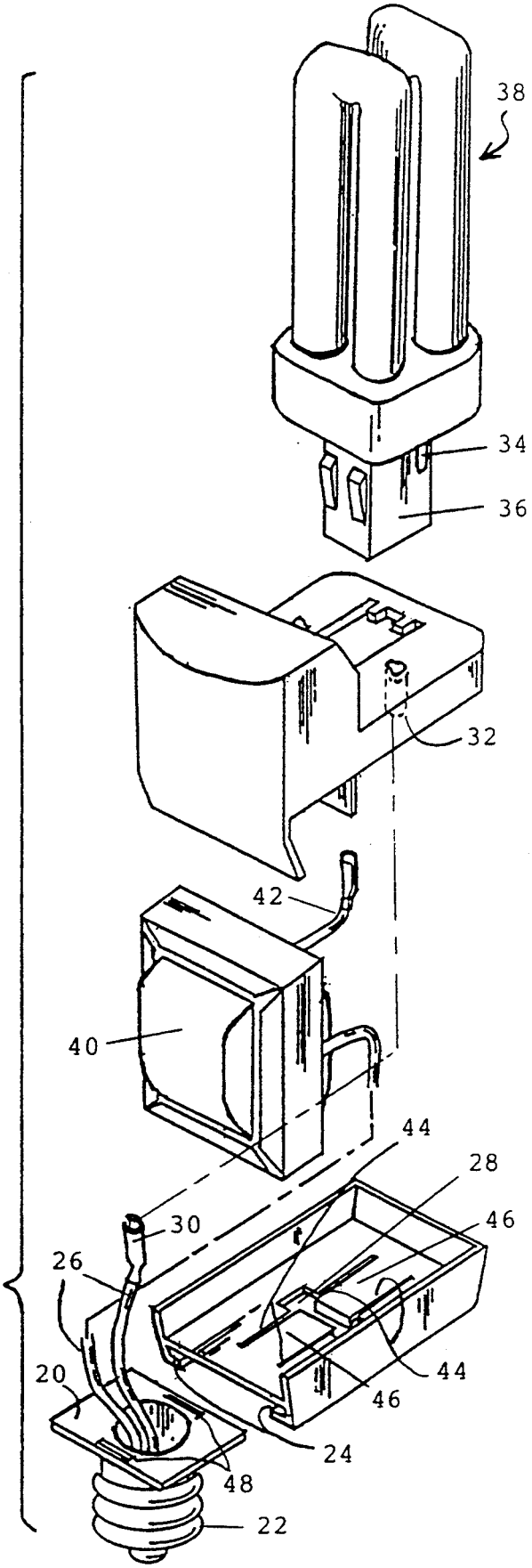
FIG. 2 is the sliding component embodiment of FIG. 1 shown in exploded perspective.
Figure 3:
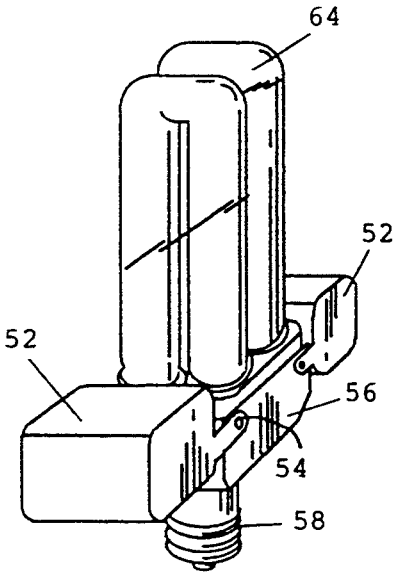
FIG. 3 is a perspective view of a second embodiment of the adaptor illustrated in use with the ballast housing lobes pivoted to the sides.
Figure 5:
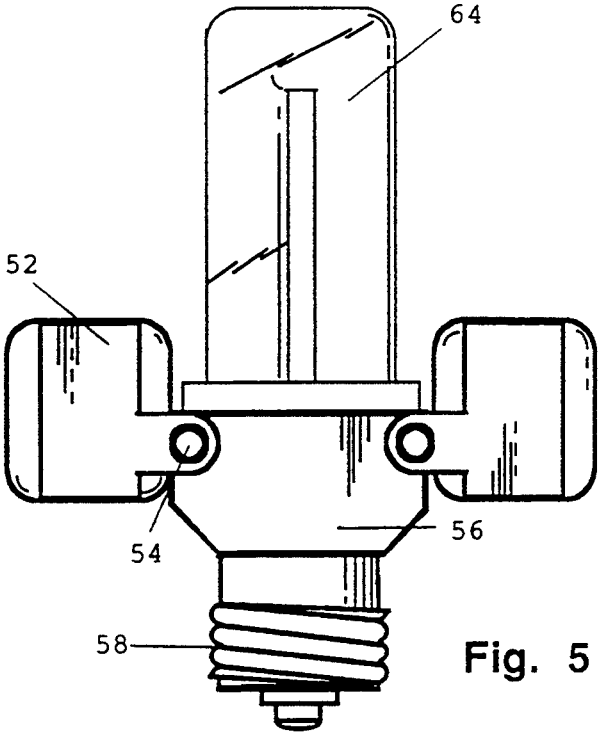
FIG. 5 is a side elevation view identical to FIG. 4 but illustrating the unit with the lobes pivoted outwardly, as in FIG. 3 in its in-use, or operational, mode.

As shown in FIG. 2, the base 14 has slideplate 20 mounted atop the threaded conductor contact 22 typical of incandescent light bulbs. The slideplate 20 is engaged in the opposed tracks 24. The wires 26 trail up from the conductor portions of the base and pass through access opening 28 into the interior of the housing. One of the wires terminates in a copper sleeve 30 which seats inside the hollow post 32 molded into the plastic, to make frictional contact with the lamp pin 34 extending down alongside the fluorescent tube base post 36 of the tube fixture 38. The other wire connects to the ballast 40, which also has a wire 42 extending to a copper sleeve to connect to the other lamp pin, not shown. The lower portion of the housing is provided with parallel slots 44 which define therebetween tension strips 46, whose purpose it is to ride on projecting ribs 48 of the base so that the base will stay where it is positioned.

Figure 4:
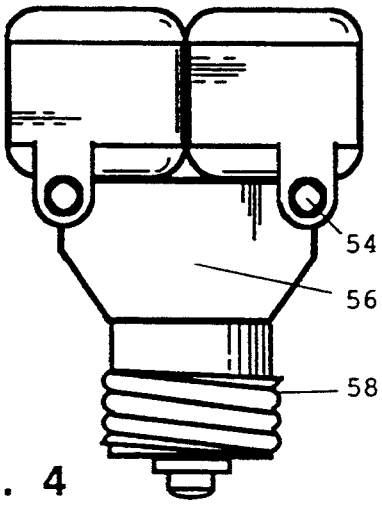
FIG. 4 is a side elevation view of the embodiment of FIG. 3 illustrated in its installation mode.

The second embodiment of the invention is shown in FIGS. 3 through 6. In this embodiment, the portions of the body that move relative to other portions do not slide, but are hinged. Two side lobes 52 are pivoted at 54 to the main, central body portion 56 which mounts the base 58. The ballast is preferably divided into two parts, each part being housed in a respective one of the side lobes as indicated at 60 in FIG. 6. The two pivotal side lobes are swung up over the threshold 62 of the tube mounting socket of the adaptor. FIG. 4 illustrates how compactly the ballast can be configured, at least in planform in the plane orthogonal to the axis of the threaded base. Its profile or planform is scarcely larger than the top portion of the mounting socket. With a profile this compact, the unit can be installed in most places previously using an incandescent bulb. Of course, there must be adequate room to expand the lobes into the operational position shown in FIG. 5 so that the fluorescent tube 64 can be installed.

Figure 6:
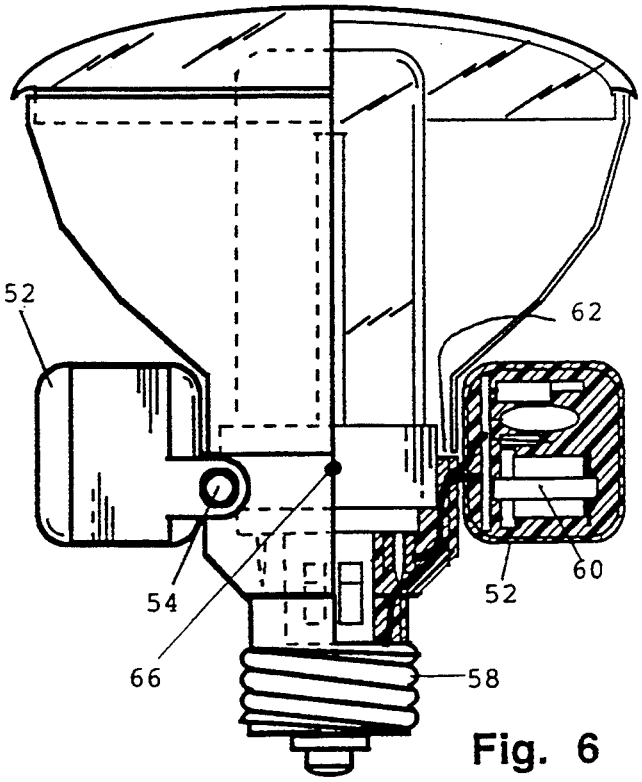
FIG. 6 is a partial section taken through a mounting fixture using a modern electronic ballast, with a parabolic reflector lamp to illustrate use in this mode despite the presence of the lobes.

In FIG. 6, a parabolic reflector lamp is shown to make the point that the wide, expanding portion of the reflector will fit between the two expanded lobes.

The fluorescent tube has a hot spot which is indicated at 66 in FIG. 6, inside the mounting base of the tube fixture. The hot spot corresponds to the location of the electrodes inside the ends of the tube. It is very important to ventilate the portions of the tube around the hot spot as well as possible. For this reason, in all embodiments shown in the operative mode there is an air space between the ballast and the fluorescent tube. This extends the lives of both the tube and the ballast, as when each heats the other, they both suffer reduced useful life.

Figure 10:
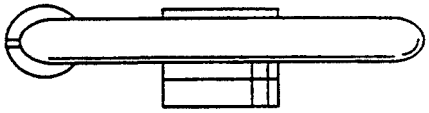
FIG. 10 is a side elevation view identical to FIG. 8 but with the pivotal lamp holder in its axially oriented mode.

FIG. 10 is a top plan view of the "2D" tube fixture that the third embodiment of the invention is designed to work witch. This configuration is also the one to which the previously patent by the same inventor was directed. This configuration expands the fluorescent lamp laterally of the mounting axis rather than extending parallel with it.

Figure 7:
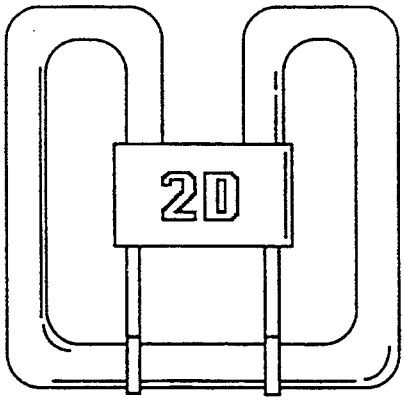
FIG. 7 is a top plan view of the "2D" compact fluorescent lamp to which the mounting fixtures are particularly directed.

The third embodiment of the invention which utilizes the tube configuration of FIG. 7 is shown in FIGS. 8–12. This embodiment has a main body 68 with the threaded mounting base 70 depending from the lower end. A lampholder 72 is pivoted to the main body. This adaptor is sufficiently compact in the planform dimension that is could probably be installed in most configurations in either the laterally directed configuration of FIGS. 8 and 9 or the vertically oriented configuration of FIG. 10. The lampholder can be fixed at either one of these 90 degree locations, or anywhere in between. In the many situations in which the installation was designed around an incandescent light bulb, there may be an obstacle on one side or the other of the socket which would prevent the FIG. 10 configuration from being used. Considering that the adaptor has 180 degrees, or close to 180 degrees, of rotational play, the 90 degrees of freedom along another axis provided by the FIGS. 8–10 configuration actually accompanies many different installation situations. The fixture can be rotated and tilted simultaneously, or even rotated about both the tilt axis and the bulb socket axis while axially slid if the FIG. 9 sliding base is used.

Figure 8:
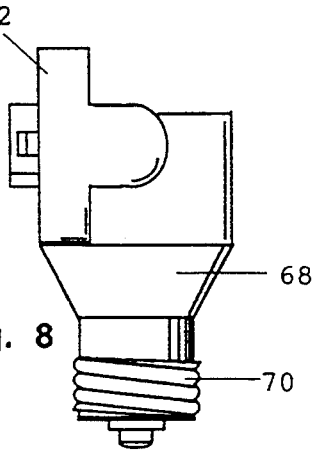
FIG. 8 is a side elevation view of a third embodiment of the invention having a single pivotal tube mount shown in its laterally oriented mode.
Figure 9:
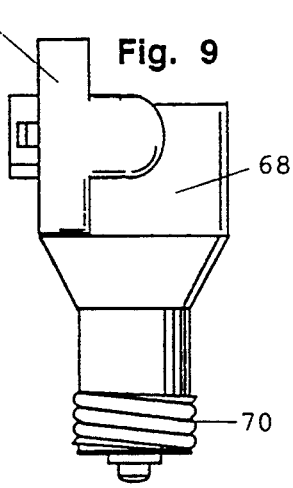
FIG. 9 is a side elevation view identical to FIG. 8 but showing the base being slide out.

Options possible in either the second or third embodiments, or even the first for that matter, include the above-referenced axially slidable base unit, indicated by the extended axial base dimension of FIG. 9 compared to FIGS. 8 & 10, and a ratchet-type base which permits the base to rotate relative to the rest of the structure so that it can be rotated into place without turning the rest of the adaptor body.

Figure 11:
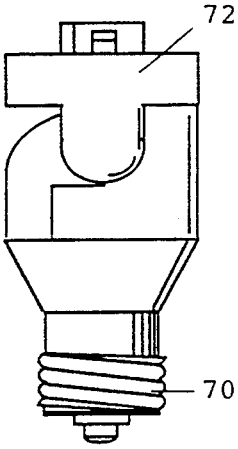
FIG. 11 is a side elevation view of another species of the sliding lamp holder embodiment; and, FIG. 12 illustrates the species of FIG. 11 after installation.
Figure 11:
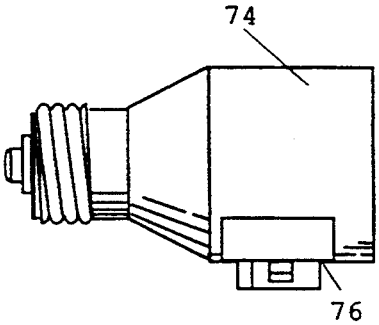
Figure 12:
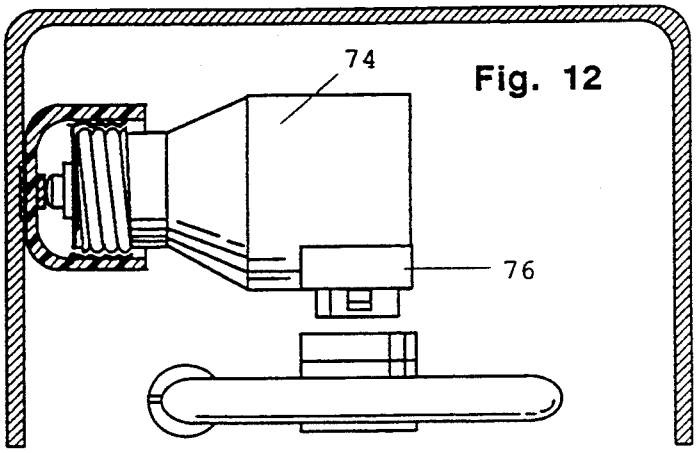

A variation of the third embodiment is shown in FIGS. 11 and 12. This is also a side-mounted adaptor, having a main body 74 in a sliding lampholder 76 mounted on the side. This lampholder slides axially. With the sliding feature the necessary clearance is provided between any structure surrounding the light bulb adjacent the mounting socket. A typical installation using the species of FIGS. 11 and 12 is shown in FIG. 12, in which a side-mount light can is used. It can be seen from this figure how a typical incandescent lighting configuration would not work with a conventional fluorescent, even compacted to the extent of the "2D" tube, without the addition of applicant's device or something similar.

The invention disclosed and claimed herein takes advantage of the relatively recently developed electronic ballast, which eliminates the need for heavy and bulky transformer core and coils in favor of lightweight, compact, relatively cool operating solid state circuitry. An additional advantage is that the solid state circuitry can be divided into two or more parts, making it possible to house in movable lobes and other available cavities inside various adaptor parts, including for example the space inside the adaptor base which is screwed into a bulb socket.

It is hereby claimed:

1. An adaptor for adapting a fluorescent tube structurally and electrically to an incandescent light socket, comprising:

(a) an adaptor body member;

(b) an adaptor base member non-releasibly mounted to said body member and defining a base connector defining a coaxial longitudinal axis and being adapted to insert into an incandescent light socket;

(c) a ballast housed in at least one of said members, and one of said members defining a tube socket for a fluorescent tube and including circuitry operatively and non-separably interconnecting said ballast, tube mounting and base connector;

(d) one of said members comprising a stationary component, and one of said members defining a movable component movably and non-releasibly mounted to said stationary component; and, (e) said movable component being movable relative to said stationary component between an operating mode in an operating mode orientation defining a first planform dimension in at least one projected plane, and an installation mode defining a second planform dimension in said projected plane, with said second planform dimension being less than said first planform dimension to facilitate installation of a bulb socket defined in a confined space by permitting re-orientation of said members relative to one another for a minimal installation profile while said members remain continuously integral both electrically and structurally before, during and after installation.

2. An adaptor for adapting a fluorescent tube structurally and electrically to an incandescent light socket, comprising:

(a) an adaptor body member;

(b) an adaptor base member mounted to said body member and defining a base connector defining a coaxial longitudinal axis and being adapted to insert into an incandescent light socket;

(c) a ballast housed in at least one of said members, and one of said members defining a tube socket for a fluorescent tube and including circuitry operatively interconnecting said ballast, tube mounting and base connector;

(d) one of said members comprising a stationary component, and one of said members defining a movable component movably mounted to said stationary component;

(e) said movable component being movable relative to said stationary component between an operating mode in an operating mode orientation defining a first planform dimension in at least one projected plane, and an installation mode defining a second planform dimension in said projected plane, with said second planform dimension being less than said first planform dimension to facilitate installation of a bulb socket defined in a confined space, and, (f) said adaptor base member being slidably mounted on said adaptor body member such that said adaptor body member is slidable with a lateral component of motion relative to said longitudinal axis and said adaptor body member is substantially central over said adaptor base member in said installation mode.

3. Structure according to claim 2 wherein said bulb socket has an open bulb-receiving bulb socket threshold, and said tube has a tube base for seating in said tube socket, and when in said operating mode said tube socket is substantially axially aligned with said bulb socket and nested therein such that a tube base inserted into said tube socket extends beyond said bulb socket threshold to partly occupy space within said socket.

4. Structure according to claim 3 wherein said adaptor body member has a lateral slide direction and is elongated in said lateral slide direction and said tube socket is defined eccentrically of said adaptor body member along said lateral slide direction to permit said adaptor body member to be centered over said adaptor base member in said installation mode and slid eccentrically thereof in said operating mode to align said tube socket with said bulb socket.

5. Structure according to claim 4 wherein said adaptor base member is rotatable about said longitudinal axis to permit optimal alignment of said adaptor base member in said operating mode.

6. Structure according to claim 5 wherein said tube socket is defined toward one end of said elongated adaptor body member compared to the other end thereof, and including a lobe defined by said adaptor body member extending alongside a fluorescent tube mounted in said tube socket and housing said ballast.

7. An adaptor for adapting a fluorescent tube structurally and electrically to an incandescent light socket, comprising:

(a) an adaptor body member;

(b) an adaptor base member mounted to said body member and defining a base connector defining a coaxial longitudinal axis and being adapted to insert into an incandescent light socket;

(c) a ballast housed in at least one of said members, and one of said members defining a tube socket for a fluorescent tube and including circuitry operatively interconnecting said ballast, tube mounting and base connector;

(d) one of said members comprising a stationary component, and one of said members defining a movable component movably mounted to said stationary component;

(e) said movable component being movable relative to said stationary component between an operating mode in an operating mode orientation defining a first planform dimension in at least one projected plane, and an installation mode defining a second planform dimension in said projected plane, with said second planform dimension being less than said first planform dimension to facilitate installation of a bulb socket defined in a confined space; and, (f) said tube socket defining a tube mounting threshold and said adaptor body member defining an adaptor base member-mounting component and a first hinged lobe which is hinged to said adaptor base member-mounting component and which swings from a position substantially across the threshold of said tube socket in said installation mode, to a position clear of said threshold substantially laterally extended relative to said tube socket in said operating mode.

8. Structure according to claim 7 wherein said adaptor body member defines a tube-socket-defining portion and said lobe is a first lobe and is hinged to said tube-socket-defining portion on one side thereof, and including a second lobe in said portion on the opposite side thereof from said first lobe, and said lobes are configured, dimensioned and mounted to permit them to swing over said tube socket threshold into substantial inwardly rotated mutual juxtaposition, and said lobes house at least a portion of said ballast.

9. Structure according to claim 7 wherein said tube socket is substantially aligned with said adaptor base member and extended down into same such that when a fluorescent tube is mounted in said tube socket said tube base inserts beyond the threshold of said bulb socket.

10. Structure according to claim 9 wherein said adaptor base member is rotatable about its longitudinal axis relative to said adaptor body member to permit optimal angular alignment of said adaptor body member about said longitudinal axis in said operating mode.

11. Structure according to claim 9 wherein said adaptor body member has a lampholder tube-socket-defining portion surrounding and defining said tube socket, and said hinged lobe occupies substantially the same planform area in said plane as said tube-socket-defining portion when in said installation mode to substantially maximize ballast housing volume in said adaptor body member while minimizing the planform of said adaptor in said plane.

12. Structure according to claim 7 wherein said lobe defines said tube socket such that a fluorescent tube mounted in said adaptor can be angled at a plurality of selectable angular orientations relative to said longitudinal axis.

13. Structure according to claim 12 wherein said hinged lobe is pivotal between an orientation point in which a tube mounted therein is substantially orthogonal to said long axis in said adaptor base member to a position substantially coaxial therewith.

14. An adaptor for adapting a fluorescent tube structurally and electrically to an incandescent light socket, comprising:

(a) an adaptor body member;

(b) an adaptor base member mounted to said body member and defining a base connector defining a coaxial longitudinal axis and being adapted to insert into an incandescent light socket;

(c) a ballast housed in at least one of said members, and one of said members defining a tube socket for a fluorescent tube and including circuitry operatively interconnecting said ballast, tube mounting and base connector;

(d) one of said members comprising a stationary component, and one of said members defining a movable component movably mounted to said stationary component;

(e) said movable component being movable relative to said stationary component between an operating mode in an operating mode orientation defining a first planform dimension in at least one projected plane, and an installation mode defining a second planform dimension in said projected plane, with said second planform dimension being less than said first planform dimension to facilitate installation of a bulb socket defined in a confined space; and, (f) said adaptor body member being slidable coaxially relative to said adaptor base member.

15. An adaptor for adapting a fluorescent tube structurally and electrically to an incandescent light socket, comprising:

(a) an adaptor body member;

(b) an adaptor base member mounted to said body member and defining a base connector defining a coaxial longitudinal axis and being adapted to insert into an incandescent light socket;

(c) a ballast housed in at least one of said members, and one of said members defining a tube socket for a fluorescent tube and including circuitry operatively interconnecting said ballast, tube mounting and base connector;

(d) one of said members comprising a stationary component, and one of said members defining a movable component movably mounted to said stationary component;

(e) said movable component being movable relative to said stationary component between an operating mode in an operating mode orientation defining a first planform dimension in at least one projected plane, and an installation mode defining a second planform dimension in said projected plane, with said second planform dimension being less than said first planform dimension to facilitate installation of a bulb socket defined in a confined space; and, (f) said adaptor body member being slidable transversely of said axis longitudinally relative to said adaptor base member.

* * * * *